US008988009B2

(12) United States Patent
Tsao

(10) Patent No.: US 8,988,009 B2
(45) Date of Patent: Mar. 24, 2015

(54) LED DRIVER APPARATUS

(71) Applicant: Princeton Technology Corporation, New Taipei (TW)

(72) Inventor: Ming-Yuan Tsao, New Taipei (TW)

(73) Assignee: Princeton Technology Corporation, New Taipei (TW)

( * ) Notice: Subject to any disclaimer, the term of this patent is extended or adjusted under 35 U.S.C. 154(b) by 0 days.

(21) Appl. No.: 13/928,920

(22) Filed: Jun. 27, 2013

(65) Prior Publication Data

US 2014/0203732 A1 Jul. 24, 2014

(30) Foreign Application Priority Data

Jan. 21, 2013 (TW) ..... 102102161 A

(51) Int. Cl.
*G05F 1/46* (2006.01)
*H05B 33/08* (2006.01)

(52) U.S. Cl.
CPC ..... *H05B 33/0824* (2013.01)
USPC ..... 315/307; 315/186; 323/282

(58) Field of Classification Search
CPC ..... H05B 41/36
USPC ..... 315/307, 186, 291; 323/282
See application file for complete search history.

(56) References Cited

U.S. PATENT DOCUMENTS 6,864,641 B2 * 3/2005 Dygert ..... 315/216
7,372,322 B2 * 5/2008 Yamamoto et al. ..... 327/543
7,504,880 B1 * 3/2009 Nodake et al. ..... 330/86
7,570,044 B2 * 8/2009 Takeda ..... 324/117 H
7,605,647 B1 * 10/2009 Romero et al. ..... 330/9
7,898,187 B1 * 3/2011 Mei et al. ..... 315/247
7,977,891 B2 * 7/2011 Shiu et al. ..... 315/291
8,228,005 B2 * 7/2012 Ohtaka et al. ..... 315/307
8,237,425 B1 * 8/2012 Smith et al. ..... 323/314
8,410,711 B2 * 4/2013 Lin et al. ..... 315/224
8,564,219 B2 * 10/2013 Lee et al. ..... 315/291
8,618,745 B2 * 12/2013 Tsuchida et al. ..... 315/294
8,716,947 B2 * 5/2014 Elder ..... 315/224
2006/0226898 A1 * 10/2006 Vitunic et al. ..... 330/9
2008/0122491 A1 * 5/2008 Kuan ..... 327/43
2011/0285321 A1 * 11/2011 Li et al. ..... 315/307
2013/0057175 A1 * 3/2013 Chuang et al. ..... 315/240
2013/0076252 A1 * 3/2013 Shao et al. ..... 315/186
2013/0147376 A1 * 6/2013 Trainor et al. ..... 315/200 R

* cited by examiner

*Primary Examiner* — Douglas W Owens
*Assistant Examiner* — Wei Chan
(74) *Attorney, Agent, or Firm* — Muncy, Geissler, Olds & Lowe, P.C.

(57) ABSTRACT

A LED driving apparatus includes: an output transistor, having a drain coupled to the LED; a node, coupled to a source of the output transistor; a ground transistor, having a drain coupled to the node, and a source coupled to the ground; an operational amplifier, including: a first input end and a second input end, for respectively receiving a driving signal and a feedback signal; and an output end, for outputting an output signal to a gate of the output transistor; a compensating capacitor, including a first end and a second end; and a switching unit, for switching between a first connection mode and a second connection mode, so as to offset a bias difference to the node for compensating the bias difference of the operational amplifier.

6 Claims, 4 Drawing Sheets

LED DRIVER APPARATUS

CROSS REFERENCE TO RELATED APPLICATIONS

This Non-provisional application claims priority under 35 U.S.C. §119(a) on Patent Application No(s).102102161, filed in Taiwan, Republic of China on Jan. 21, 2013, the entire contents of which are hereby incorporated by reference.

BACKGROUND OF THE INVENTION

1. Field of the Invention

The present invention is related to the LED driving circuits, and in particular, related to the LED driving circuits that suppress brightness error.

2. Description of the Related Art

In a LED display, brightness errors often occur among different modules because of the driving current variations thereof. For a full-color display, when the driving current is inaccurate, the screen is prone to color blocks, and the display quality is negatively affected.

Brightness errors usually occur due to inter-channel current errors or inter-chip current errors. The inter-chip current errors are caused due to process drift between different ICs which are manufactured in different batches. Though it is difficult to prevent process drifts, there are various manners in the prior art to deal with the inter-chip current errors. The contemporary approaches have limited effect on obliterating the inter-chip current errors.

In general, the human eyes can discern the brightness difference of 6% difference or above, the human eyes can even discern the brightness difference of 1% for low-brightness image frames. Thus, merely obviating the inter-chip current errors is insufficient to meet the requirements of today's high-definition displays. In view of this deficiency, the present invention provides new LED drivers that suppress brightness errors of the LED display by reducing the inter-channel current errors.

BRIEF SUMMARY OF THE INVENTION

The present invention provides a LED driving apparatus. The apparatus comprises: an output transistor, having a drain coupled to the LED, a source, and a gate; a node, coupled to the source of the output transistor; a ground transistor, having a drain coupled to the node, and a source coupled to the ground; an operational amplifier, comprising: a first input end and a second input end, for respectively receiving a driving signal and a feedback signal; and an output end, for outputting an output signal to the gate of the output transistor; a compensating capacitor, comprising a first end and a second end; and a switching unit, for switching between a first connection mode and a second connection mode. Under the first connection mode, the compensating capacitor stores a bias difference between the first input end and the second input end of the operational amplifier, and under the second connection mode, the compensating capacitor compensates the bias difference by offsetting the stored bias difference to the node.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
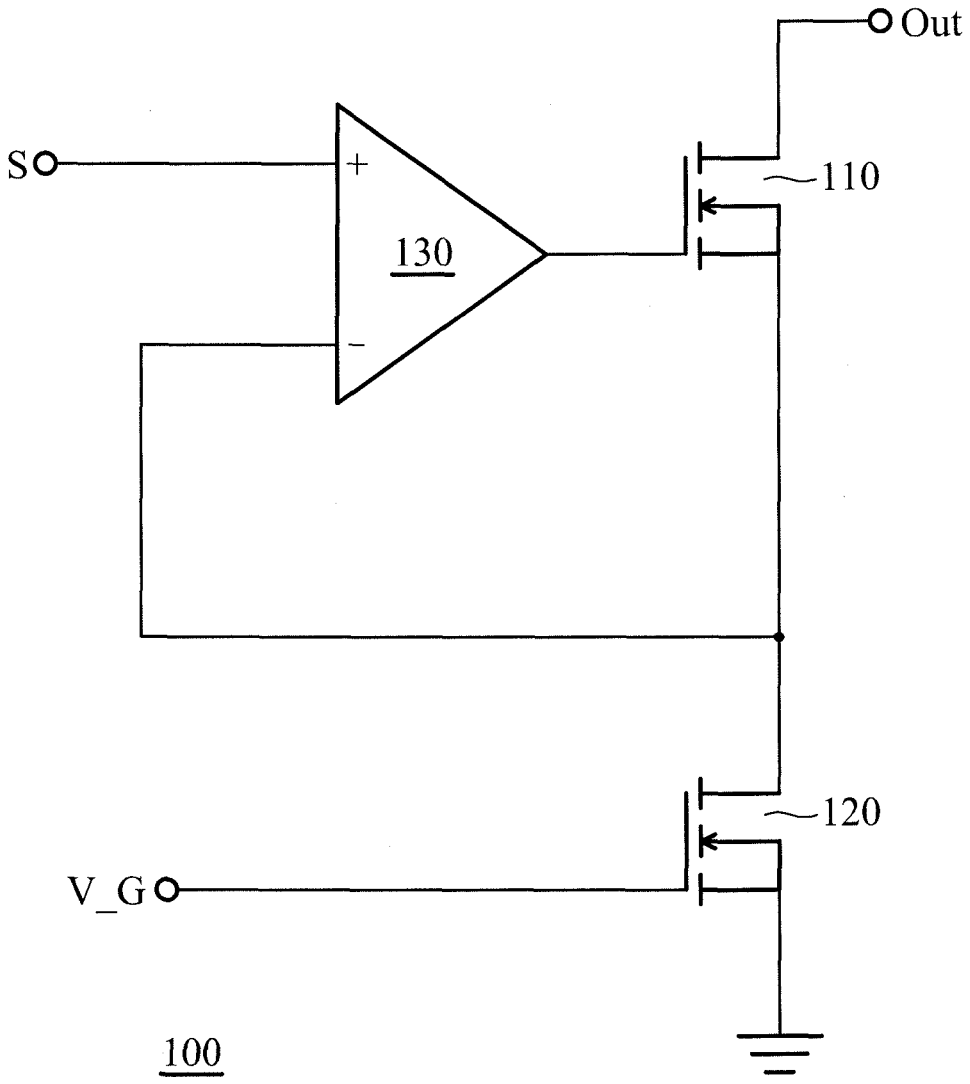
FIG. 1 ( PRIOR ART )
FIG. 1 is a schematic diagram of a LED driving apparatus according to the prior art.

FIG. 1 is a schematic diagram of a LED driving apparatus according to the prior art. In FIG. 1, the LED driving apparatus 100 comprises an output NMOS transistor 110, a ground NMOS transistor 120, and an operational amplifier 130. The output NMOS transistor 110 has a drain and a source, where the drain is connected to the output end Out, and the source is connected in series to the drain of the ground NMOS transistor 120. The output end Out is further connected to a LED (not shown). The ground NMOS transistor 120 has a gate for receiving a constant voltage V_G and a source connected to the ground. The operational amplifier 130 can receive a driving signal S, and output a voltage to the gate of the NMOS transistor 110. With this negative feedback configuration, the operational amplifier 130 provides a voltage to the gate of the NMOS transistor 110, so that the source of the NMOS transistor 120 keeps the same voltage with the node S. The operational amplifier 130 drives the ground NMOS transistor 120 to operate in a linear region, and steers the driving current on the LED to the ground through the output end OUT.

It is noteworthy that the inter-channel current errors are caused by: (1) the NMOS transistor 120; and (2) the bias difference of the operational amplifier 130. To reduce the he inter-channel current errors caused by the NMOS transistor 120, the transistor area usually has to be enlarged, thereby increasing costs. The LED driving apparatus of the present invention is aimed to lower the influences as a result of the bias difference of the operational amplifier.

Figure 2A:
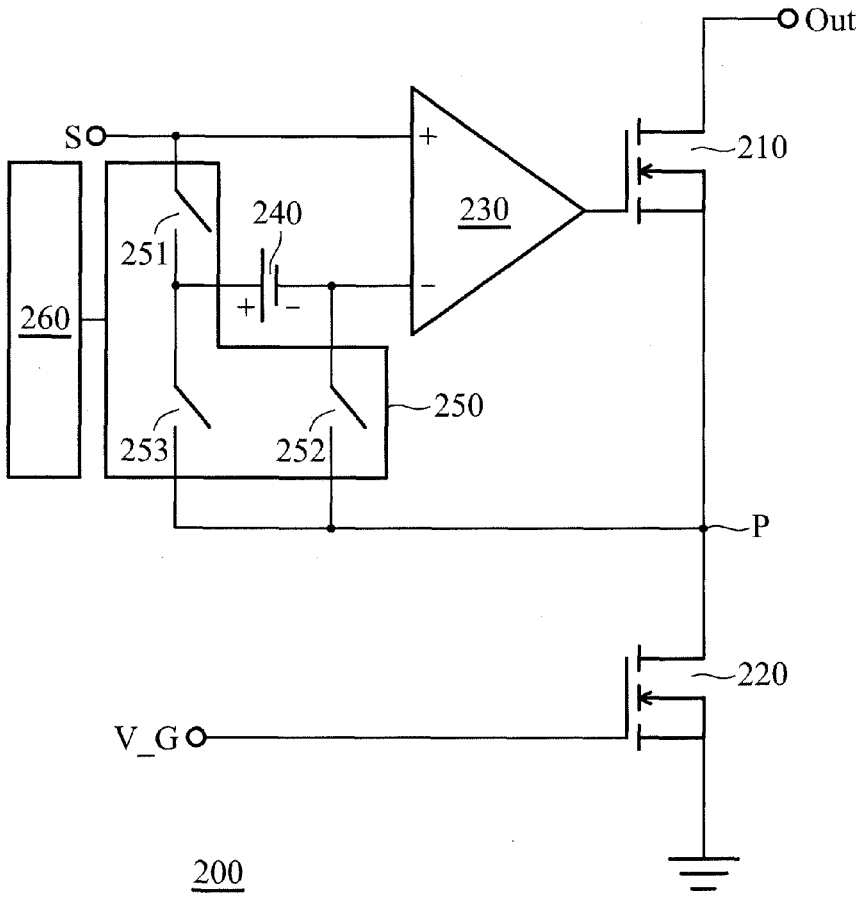
FIG. 2A is a schematic diagram of the LED driving apparatus according to an embodiment of the present invention.

FIG. 2A is a schematic diagram of the LED driving apparatus according to an embodiment of the present invention. In this embodiment, the LED driving apparatus 200 comprises: an output transistor 210, a ground transistor 220, an operational amplifier 230, a compensating capacitor 240, a switching unit 250 and a controller 260. These components will be described in the following in accordance with FIG. 2A.

In the embodiment, the output transistor 210 and the ground transistor 220 are both NMOS transistors. The output transistor 210 has a drain and a source, where the drain is coupled to the output end Out and further coupled to the LED (not shown), and the source is coupled to a node P. The ground transistor has a drain, a source and a gate, where the drain is coupled to the node P, the source is grounded, and the gate is coupled to a power supply V_G, as shown in FIG. 2.

The operational amplifier 230 has two input ends (labeled as "+" and "−", respectively), for respectively receiving a driving signal S and a negative feedback signal from the node P. In addition, the operational amplifier 230 further comprises an output end for providing an output voltage to the gate of the output transistor 210. Due to the process drift, it is difficult for the voltages on the two input ends of the operational amplifier 230 to be identical to each other, thereby causing the bias difference on the node P and affecting the current accuracy.

To suppress the bias difference described above, the present invention provides a compensating capacitor 240 and a switching unit 250. In the present invention, the switching unit 250 is switched between a first connection mode and a second connection mode in order to change the connection among the compensating capacitor 240 and other components of the LED driving apparatus 200. Under the first connection mode, the compensating capacitor 240 stores a bias difference between the first input end ("+") and the second input end ("−") of the operational amplifier 230. Under the second connection mode, the compensating capacitor 240 offsets the bias difference stored in the first connection mode to the node P. As such, the bias difference which causes the unstable current can be compensated through the switching of the switching unit 250. In an embodiment of the present invention, the switching unit 250 is composed of three switches 251, 252 and 253, which will be further described in the following embodiment by illustrating the first connection mode and the second connection mode of the present invention. However, it is to be noted that the switching unit 250 of the present invention should not be limited thereto, and those skilled in the art can implement the switching unit 250 in various manners.

Figure 2B:
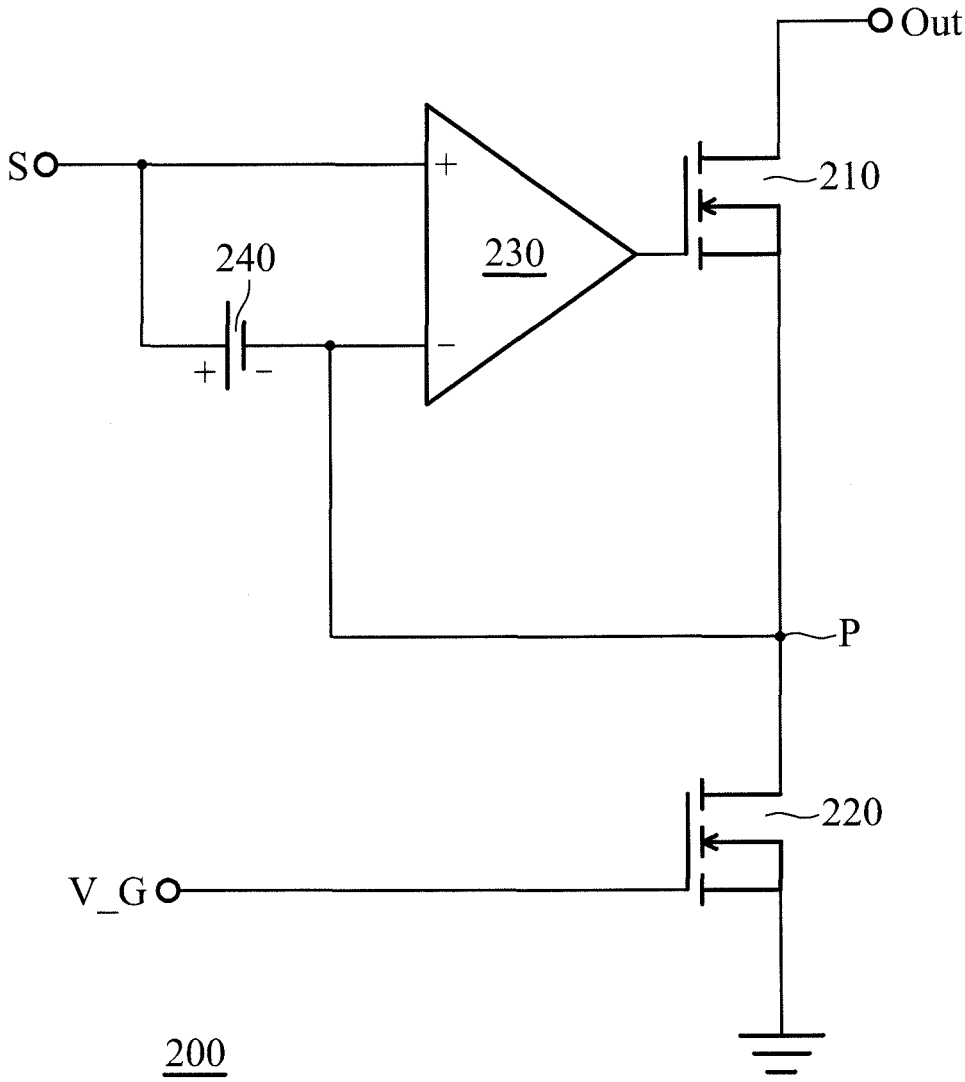
FIG. 2B shows the LED driving apparatus 200 of FIG. 2A operating under the first connection mode.

FIG. 2B shows the LED driving apparatus 200 of FIG. 2A operating under the first connection mode. Please refer to FIGS. 2A and 2B. Under the first connection mode, the switches 251 and 252 of the switching unit 250 are closed, and the switch 253 is open. Meanwhile, the first end (the positive end) of the compensating capacitor 240 is coupled to the driving signal S and the first input end ("+") of the operational amplifier 230, and the second end (the negative end) of the compensating capacitor 240 is coupled to the second input end ("−") of the operational amplifier 230 and the node P. The first connection mode is set to store the bias difference between the first input end ("+") and the second input end ("−") of the operational amplifier 230.

Figure 2C:
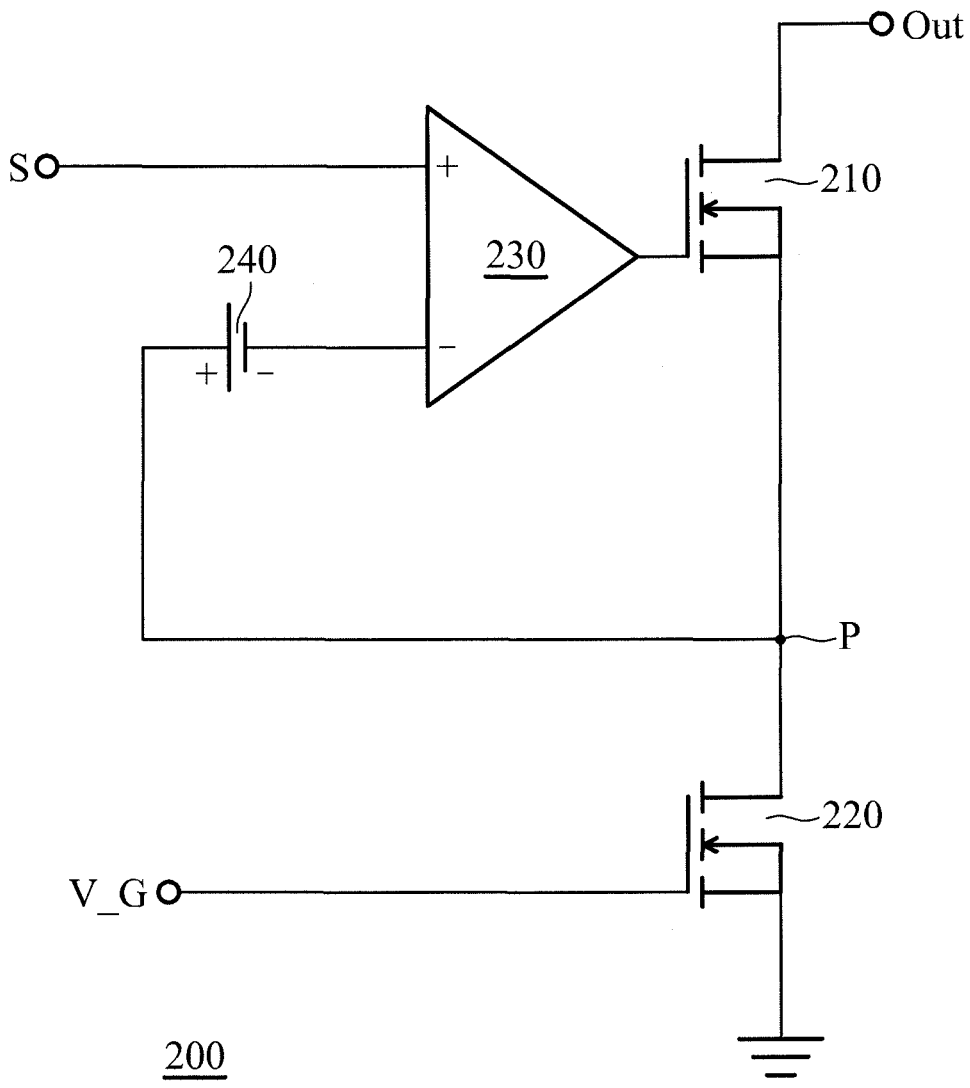
FIG. 2C shows a LED driving apparatus 200 of FIG. 2A operating under the second connection mode.

FIG. 2C shows an LED driving apparatus 200 of FIG. 2A operating under the second connection mode. Please refer to FIGS. 2A and 2C. In contrast to the first connection mode, the switches 251 and 252 are open, and the switch 253 is closed under the second connection mode. Meanwhile, the first end (the positive end) of the compensating capacitor 240 is coupled to the node P, and the second end (the negative end) of the compensating capacitor 240 is coupled to the second input end ("−") of the operational amplifier 230. The second connection mode is set to offset the bias difference which is stored in the first connection mode to the node P. By switching the operation mode of the driving apparatus between the two modes, the bias difference caused by the operational amplifier 230 can be compensated.

To make sure that each switch of the switching unit 250 operates correctly, the LED driving apparatus of the present invention further comprises a controller 260. The controller 260 of the present invention can not only coordinate the switching of the switches of the switching unit 250, but also controls the switching frequency and switching period of the switching unit 250. Those skilled in the art can set an appropriate switching frequency based on specifications of the components of the LED driving apparatus 200 (for example, the capacitance of the compensating capacitor 24), and thus the details in connection with the setting of the switching frequency will not be further discussed.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A LED driving apparatus, comprising: an output transistor, having a drain coupled to the LED, a source, and a gate; a node, coupled to the source of the output transistor; a ground transistor, having a drain coupled to the node, and source coupled to ground; an operational amplifier, comprising: a first input end and a second input end, for respectively receiving a driving signal and a feedback signal; and an output end, for providing an output signal to the gate of the output transistor; a compensating capacitor, comprising a first end and a second end; and a switching unit, for switching between a first connection mode and a second connection mode, wherein, under the first connection mode, the compensating capacitor stores a bias difference between the first input end and the second input end of the operational amplifier, and under the second connection mode, the compensating capacitor offsets a stored bias difference to the node wherein, under the first connection mode, the first end of the compensating capacitor is coupled to the driving signal and the first input end of the operational amplifier, and the second end of the compensating capacitor is connected to the second input end of the operational amplifier and the node.

2. The LED driving apparatus as claimed in claim 1, wherein, under the second connection mode, the first end of the compensating capacitor is coupled to the node, and the second end of the compensating capacitor is connected to the second input end of the operational amplifier.

3. The LED driving apparatus as claimed in claim 1, further comprising a controller, for controlling a switching frequency and a switching period of the switching unit.

4. The LED driving apparatus as claimed in claim 1, wherein the output transistor is a N-channel metal-oxide-semiconductor field-effect transistor.

5. The LED driving apparatus as claimed in claim 1, wherein the ground transistor is a N-channel metal-oxide-semiconductor field-effect transistor.

6. The LED driving apparatus as claimed in claim 1, wherein a gate of the ground transistor is coupled to a power supply.

* * * * *